US010753130B2

(12) United States Patent
Lee et al.

(10) Patent No.: US 10,753,130 B2
(45) Date of Patent: Aug. 25, 2020

(54) GARMENT PROCESSING DEVICE

(71) Applicant: LG ELECTRONICS INC., Seoul (KR)

(72) Inventors: Youngjoo Lee, Seoul (KR); Sanghun Bae, Seoul (KR); Hongjun Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/336,048

(22) PCT Filed: Sep. 22, 2017

(86) PCT No.: PCT/KR2017/010474
§ 371 (c)(1),
(2) Date: Mar. 22, 2019

(87) PCT Pub. No.: WO2018/056753
PCT Pub. Date: Mar. 29, 2018

(65) Prior Publication Data

US 2019/0226253 A1 Jul. 25, 2019

(30) Foreign Application Priority Data

Sep. 23, 2016 (KR) ..... 10-2016-0122038

(51) Int. Cl.
*D06F 37/10* (2006.01)
*E05D 7/04* (2006.01)
(Continued)

(52) U.S. Cl.
CPC ..... *E05D 7/0407* (2013.01); *D06F 37/10* (2013.01); *D06F 37/22* (2013.01); *D06F 37/28* (2013.01);
(Continued)

(58) Field of Classification Search
CPC ..... D06F 37/10; D06F 37/22; D06F 37/28; D06F 37/42; D06F 39/14; D06F 58/04;
(Continued)

(56) References Cited

U.S. PATENT DOCUMENTS 3,018,508 A * 1/1962 Keeling, Sr. ..... E05D 15/52 16/232
3,698,781 A * 10/1972 Dunn ..... D06F 58/04 312/327

(Continued)

FOREIGN PATENT DOCUMENTS

KR 20-1995-0000950 2/1995
KR 20-1995-005949 7/1995

(Continued)

OTHER PUBLICATIONS

International Search Report and Written Opinion (with English Translation) dated Jan. 4, 2018 issued in Application No. PCT/KR2017/010450.

(Continued)

*Primary Examiner* — James O Hansen
(74) *Attorney, Agent, or Firm* — Ked & Associates, LLP

(57) ABSTRACT

A door of a garment processing device includes four hinges which may be interchanged regarding a location on the door, and a series of interconnected arms that allow a pivot axis of the door to be changed from a first direction to a second direction by manipulation of a handle on the door.

20 Claims, 8 Drawing Sheets

(51) Int. Cl.

| | |
|---|---|
| ***E05D 15/50*** | (2006.01) |
| ***D06F 37/28*** | (2006.01) |
| ***D06F 37/42*** | (2006.01) |
| ***D06F 58/20*** | (2006.01) |
| ***D06F 58/04*** | (2006.01) |
| ***D06F 37/22*** | (2006.01) |
| ***D06F 39/14*** | (2006.01) |
| ***E05D 15/522*** | (2006.01) |
| ***E05D 15/52*** | (2006.01) |

(52) U.S. Cl.
CPC ..... *D06F 37/42* (2013.01); *D06F 39/14* (2013.01); *D06F 58/04* (2013.01); *D06F 58/20* (2013.01); *E05D 15/507* (2013.01); *E05D 15/52* (2013.01); *E05D 15/522* (2013.01); *D06F 2224/00* (2013.01); *E05Y 2900/312* (2013.01)

(58) Field of Classification Search
CPC ..... D06F 58/20; E05D 7/0407; E05D 15/52; E05D 15/507; E05D 15/522
USPC ..... 312/228, 326, 327; 68/212; 16/367
See application file for complete search history.

(56) References Cited

U.S. PATENT DOCUMENTS

| | | | | |
|---|---|---|---|---|
| 8,936,330 | B2 * | 1/2015 | Kim | E05D 11/06 312/298 |
| 2012/0161594 | A1 | 6/2012 | Kim et al. | |
| 2012/0187811 | A1 * | 7/2012 | Kim | E05D 15/52 312/228 |
| 2012/0217851 | A1 * | 8/2012 | Bae | D06F 37/28 312/222 |
| 2013/0076220 | A1 | 3/2013 | Yeom et al. | |
| 2013/0193823 | A1 * | 8/2013 | Cho | D06F 39/14 312/319.2 |
| 2014/0035453 | A1 | 2/2014 | Kwon et al. | |
| 2015/0233043 | A1 | 8/2015 | Sim et al. | |
| 2016/0076187 | A1 | 3/2016 | Lee et al. | |
| 2016/0194802 | A1 | 7/2016 | Heo et al. | |
| 2017/0009392 | A1 | 1/2017 | Lee et al. | |

FOREIGN PATENT DOCUMENTS

| | | |
|---|---|---|
| KR | 20-0138847 | 4/1999 |
| KR | 20-1999-0029441 | 7/1999 |
| KR | 10-0640751 | 10/2006 |
| KR | 10-2013-0032993 | 4/2013 |
| KR | 10-2013-0071844 | 7/2013 |
| KR | 10-2014-0018565 | 2/2014 |
| KR | 10-2015-0097185 | 8/2015 |
| KR | 10-2015-0109814 | 10/2015 |
| KR | 10-2016-0084327 | 7/2016 |
| KR | 10-1653314 | 9/2016 |

OTHER PUBLICATIONS

International Search Report and Written Opinion (with English Translation) dated Jan. 11, 2018 issued in Application No. PCT/KR2017/010479.
International Search Report and Written Opinion (with English Translation) dated Jan. 11, 2018 issued in Application No. PCT/KR2017/010452.
International Search Report and Written Opinion (with English Translation) dated Jan. 19, 2018 issued in Application No. PCT/KR2017/010474.
U.S. Appl. No. 16/335,997, filed Mar. 22, 2019.
U.S. Appl. No. 16/336,025, filed Mar. 22, 2019.
U.S. Appl. No. 16/336,048, filed Mar. 22, 2019.
U.S. Appl. No. 16/336,057, filed Mar. 22, 2019.

* cited by examiner

GARMENT PROCESSING DEVICE

CROSS-REFERENCE TO RELATED PATENT APPLICATIONS

This application is a U.S. National Stage Application under 35 U.S.C. § 371 of PCT Application No. PCT/KR2017/010474, filed Sep. 22, 2017, which claims priority to Korean Patent Application No. 10-2016-0122038, filed Sep. 23, 2016, whose entire disclosures are hereby incorporated by reference.

TECHNICAL FIELD

The present disclosure relates to a laundry-treating apparatus.

BACKGROUND

In general, the laundry-treating apparatus refers to a collective term of home appliances capable of washing or drying laundry, or washing and drying the laundry.

In the laundry-treating apparatus, laundry washing removes contaminants from the laundry via interaction between water and detergent. Drying of laundry removes moisture contained in laundry via a hot air supply device provided in the laundry-treating apparatus.

Conventionally, a laundry-treating apparatus includes a cabinet forming an appearance, a laundry receiving portion provided in the cabinet for receiving laundry, a laundry inlet defined in the cabinet for communicating with the laundry receiving portion, and a door for opening and closing the laundry inlet.

In the conventional laundry-treating apparatus, the door is generally pivotable about a vertical axis formed along a height direction of the cabinet.

DISCLOSURE

Technical Purpose

One purpose of the present disclosure is to provide a laundry-treating apparatus in which a pivoting direction of a door is switched to open a laundry inlet.

Further, another purpose of the present disclosure is to provide a laundry-treating apparatus in which a position of one of two pivoting axes mounted on a door easily switches from a left side of the door to a right side of the door or from the right side to the left side of the door.

Further, still another purpose of the present disclosure is to provide a laundry-treating apparatus capable of minimizing a noise level when changing a pivoting axis for the door.

Technical Solution

In one aspect of the present disclosure, there is provided a laundry-treating apparatus comprising: a cabinet having a laundry inlet defined therein; a laundry receiving portion disposed in the cabinet, wherein the laundry receiving portion receives therein laundry through the laundry inlet; a door for opening and closing the laundry inlet; a first hinge including: a first shaft disposed on one of the cabinet or the door and defining a first pivoting axis for the door; and a first shaft receiving portion disposed on the other of the cabinet and the door, wherein the first shaft receiving portion removably receives the first shaft therein; and a first shaft controller configured to open or close the first shaft receiving portion to control the first shaft; a second hinge including: a second shaft coupled to the door wherein the first and second shafts define the first pivoting axis; and a third shaft for pivotably fixing the second shaft to the cabinet, wherein the third shaft defines a second pivoting axis for the door; a third hinge including: a fourth shaft disposed on one of the cabinet or the door, wherein the third and fourth shafts define the second pivoting axis; and a fourth shaft receiving portion disposed on the other of the cabinet and the door, wherein the fourth shaft receiving portion removably receives the fourth shaft therein; and a fourth shaft controller configured to open or close the fourth shaft receiving portion to control the fourth shaft; a handle pivotably disposed on the door; first and second driving portions sandwiching the handle therebetween, wherein when external force is applied to the handle, each of the first and second driving portions is constructed to move toward or away from the handle; a first driven portion having one end in contact with the first driving portion, and the other end as a free end extending towards the second hinge, wherein the first driven portion is constructed to move toward the second hinge when the first driving portion actuates the first shaft controller to move in a direction to open the first shaft receiving portion; and a second driven portion having one end in contact with the second driving portion, and the other end as a free end extending towards the third hinge, wherein the second driven portion is constructed to move toward the third hinge when the second driving portion actuates the first shaft controller to move in a direction to open the first shaft receiving portion; wherein the first shaft controller is detachably secured to a free end of the first elongated driving structure and to a free end of the second elongated driving structure, wherein the first shaft controller is detachably secured to one of the free end of the first elongated driving structure and the free end of the second elongated driving structure to open or close the first shaft receiving portion, wherein the fourth shaft controller is detachably secured to the free end of the first elongated driven structure and the free end of the second elongated driven structure, wherein the fourth shaft controller is detachably secured to one of the free end of the first elongated driven structure and the free end of the second elongated driven structure to open and close the fourth shaft receiving portion.

The first driving portion further has a first attached and detached portion into which the first shaft controller is removably received, wherein the second driving portion further has a second attached and detached portion into which the first shaft controller is removably received.

The first driven portion further has a first attached and detached portion in which the fourth shaft controller is removably received, wherein the second driven portion further has a second attached and detached portion into which the fourth shaft controller is removably received.

The first hinge further includes: a housing secured to the door, the housing defining the first shaft receiving portion; a guide disposed on the housing to guide a movement of the first shaft controller; and a first elastic member having one end fixed to the housing and the other end fixed to the first shaft controller, wherein the first elastic member presses the first shaft controller to close the first shaft receiving portion.

The apparatus further comprises: a first fastener disposed on the door for fixing the housing facing the free end of the first elongated driving structure; and a second fastener disposed on the door for fixing the housing facing the free end of the second driving portion, wherein the first fastener and the second fastener are arranged to be axial-symmetrical with each other about a vertical line passing through a center of the door.

The third hinge further includes: a third hinge body fixed to the door; a fourth shaft support for securing the fourth shaft to the third hinge body and for spacing between the fourth shaft and the third hinge body; a fourth shaft attached and detached portion fixed on the cabinet, wherein the fourth shaft attached and detached portion includes the fourth shaft receiving portion; a second elastic member having one end fixed to the third hinge body and the other end fixed to the fourth shaft controller, wherein the second elastic member is configured to press the fourth shaft controller to be withdrawn from a controlling-body receiving portion.

The third hinge further includes a guide disposed on the third hinge body, wherein the guide is constructed to guide the fourth shaft controller to be positioned in a space between the fourth shaft and the third hinge body.

The third hinge further includes a controlling-body receiving portion disposed below the fourth shaft receiving portion, wherein the fourth shaft attached and detached portion includes the controlling-body receiving portion, wherein a free end of the fourth shaft controller is removably received into the controlling-body receiving portion.

The apparatus further comprises: a cover disposed on the door for pivotably securing the second shaft to the door; a cover fastener disposed on the door for securing the cover to the door; and a body fastener disposed on the door for securing the third hinge body to the door, wherein the cover fastener and body fastener are positioned axially symmetrically to each other about a vertical line passing through a center of the door.

The handle includes: a handle body pivotally secured to the door; and first and second inputs disposed on the handle body and spaced apart from each other, wherein the first driving portion includes a first contact, wherein when the handle body pivots, the first input presses the first contact to move the first driving portion toward the handle body, wherein the second driving portion includes a second contact, wherein when the handle body pivots, the second input presses the second contact to move the second driving portion toward the handle body.

The apparatus further comprises: a first rack fixed to the first contact and protruding from the first contact toward the second contact; a second rack secured to the second contact and protruding from the second contact toward the first contact; and a connection gear to connect the first rack and the second rack, wherein the connection gear is constructed to transmit an external force between the first rack and the second rack.

The door has a first receiving space exposed to an outside and a second receiving space separated from the first receiving space via a partitioning wall, wherein the handle body includes: a first handle body having one end received in the first receiving space and pivotably secured to the door, and the other end received in the second receiving space, wherein the first handle body passes through the partitioning wall; and a second handle body coupled to the first handle body and received in the second receiving space, wherein the second handle body includes the first input and the second input, wherein when the first driving portion and the second driving portion move away from the handle body, the second handle body moves toward the partitioning wall.

The apparatus further comprises a damper to prevent the second handle body from colliding with the partitioning wall.

The damper includes an elastic body secured to one of the partitioning wall and the second handle body to prevent the second handle body from colliding against the partitioning wall.

Technical Effect

In accordance with the present disclosure, a laundry-treating apparatus in which a pivoting direction of a door is switched to open a laundry inlet may be realized.

Further, in accordance with the present disclosure, a laundry-treating apparatus in which a position of one of two pivoting axes mounted on a door easily switches from a left side of the door to a right side of the door or from the right side to the left side of the door may be realized.

Furthermore, in accordance with the present disclosure, a laundry-treating apparatus capable of minimizing a noise level when changing a pivoting axis for the door may be realized.

DETAILED DESCRIPTIONS

Figure 1:
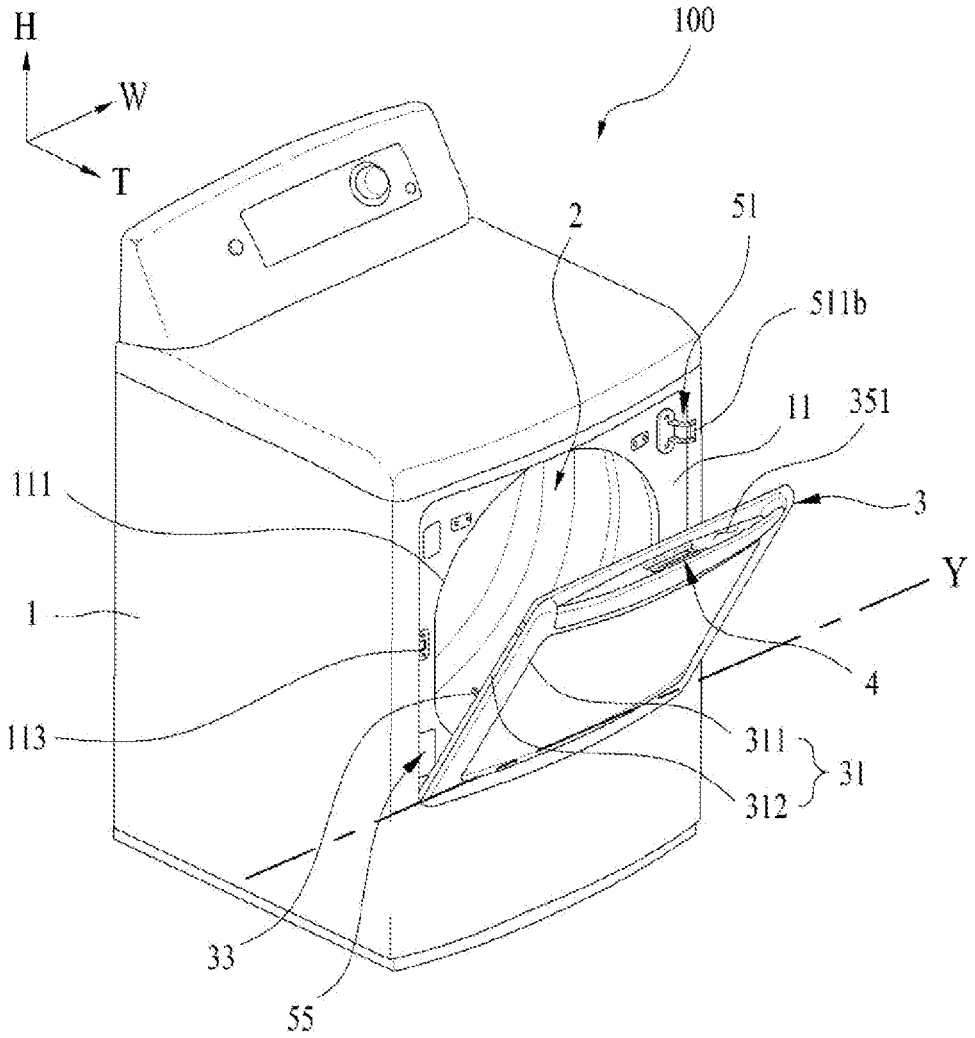
FIG. 1 shows an example of laundry-treating apparatus in accordance with the present disclosure, in which a door pivots around a second pivoting axis to open laundry inlet.

Hereinafter, preferred embodiments of the present disclosure will be described in detail with reference to the accompanying drawings. A configuration and control method of the apparatus as described below are intended to illustrate embodiments of the present disclosure and not to limit the scope of the present disclosure. Like reference numerals refer to like elements throughout the present specification.

As shown in FIG. 1, a laundry-treating apparatus 100 according to the present disclosure includes a cabinet 1 forming an appearance, a laundry receiving portion 2 defined in the cabinet 1 for accommodating laundry, and a door 3 disposed on the cabinet 1 for exposing the laundry receiving portion 2 to the outside.

A front panel 11 of the cabinet 1 has a laundry inlet 111 defined therein. The door 3 is disposed on the front panel 11 so that the laundry inlet 111 may be opened and closed by the door 3. Thus, the user may pivot the door 3 to open the laundry inlet 111 to load laundry (washing or drying target) into the laundry receiving portion 2 or draw the laundry from the receiving space 2.

When the laundry-treating apparatus 100 according to the present disclosure functions as a washing apparatus, a tub for storing wash-water therein is disposed in the cabinet, and a drum is rotatably installed in the tub and has a space for accommodating laundry defined therein. In this case, the tub has a tub laundry inlet communicating with the laundry inlet 111. The drum has a drum laundry inlet communicating with the tub laundry inlet and the laundry inlet 111.

Further, the laundry-treating apparatus 100 further includes a washing-water supply (not shown) for supplying washing water to the tub, and a washing-water discharger (not shown) for discharging washing water stored in the tub to the outside of the cabinet 1.

In an alternative, when the laundry-treating apparatus 100 according to the present disclosure only acts to dry laundry, the laundry receiving portion 2 is defined only in the drum rotatably installed in the cabinet 1. That is, the tub is absent. In this case, an air supply (not shown) is present inside the cabinet to supply hot air to the drum. Further, an air discharger (not shown) is present inside the cabinet to discharge the air from the drum to the outside of the drum.

In one example, the laundry-treating apparatus 100 according to the present disclosure may be capable of washing and drying laundry. In this case, the tub for storing wash-water therein is disposed in the cabinet, and the drum is rotatably installed in the tub and has a space for accommodating laundry defined therein. The cabinet will include a washing-water supply, a washing-water discharger, and an air supply (not shown) for supplying hot air to the tub.

The door 3 disposed on the front panel 11 for opening and closing the laundry inlet 111 is pivotable around two different pivoting axes (X, Y). The door 3 is coupled to a front panel 11 via hinges 51, 53 and 55. The user may switch the pivoting axis (X, Y) for the door 3 via the handle 4.

The door 3 may include a door body 31 for opening and closing the laundry inlet 111, and a door lock 33 for detachably fixing the door body 31 to the front panel 11.

The door body 31 may include an outer frame 311 forming an outer circumferential surface of the laundry-treating apparatus 100, and an inner frame 312 coupled to the outer frame 311 and facing the laundry inlet.

The door lock 33 may protrude from a surface of the inner frame 312. In this case, the front panel 11 may further include a door lock catch 113 into which the door lock 33 is to be accommodated. In one example, the door lock 33 and the door lock catch 113 may be embodied in any configuration as long as the door body 31 may be detachably secured to the front panel 11 via the door lock 33 and the door lock catch 113.

Figure 2:
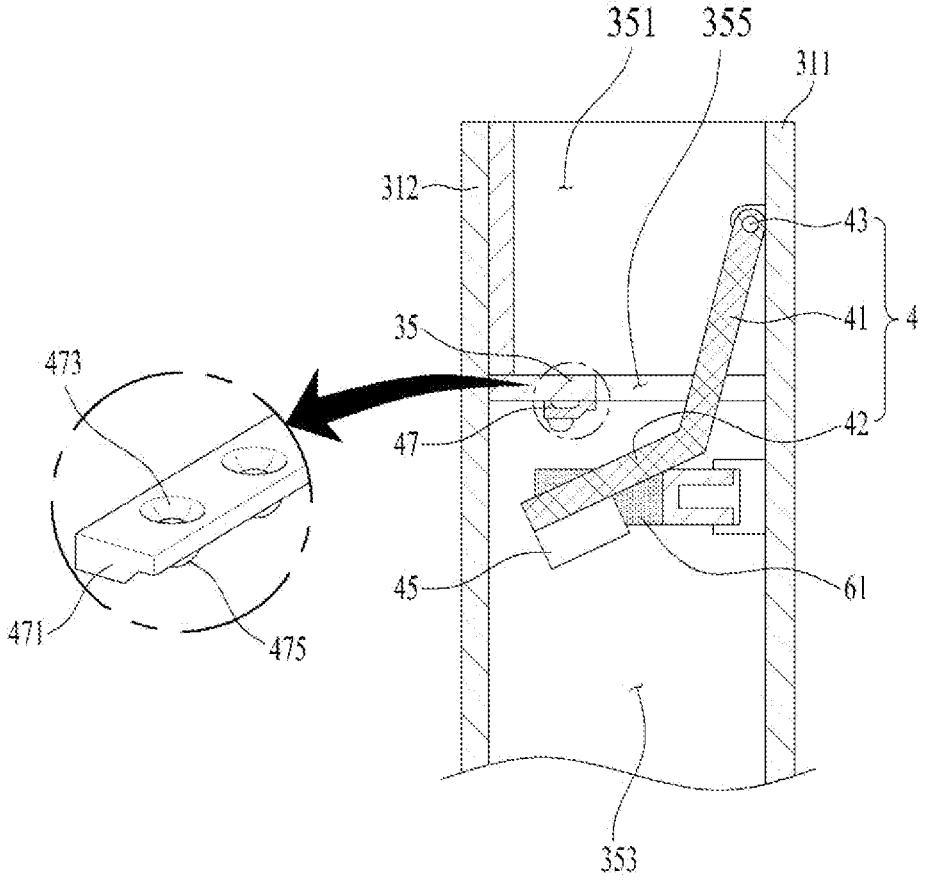
FIG. 2 shows an example of a handle and damper of a laundry-treating apparatus according to the present disclosure.

As shown in FIG. 2, the door 3 includes a first receiving space 351 exposed outside the door, and a second receiving space 353 separated from the first receiving space 351 via a partitioning wall 315 and defined inside the door.

The handle 4 may include a handle body 41 and 42 pivotably secured to the door via a hinge shaft 43. The handle body is inserted into a through-hole 355 defined in the partitioning wall 35. One end of the handle body is located in the first receiving space 351, while the other end thereof is located in the second receiving space 353.

That is, the handle body may include a first handle body (or first handle body segment) 41 located at the first receiving space 351 and a second handle body (or second handle body segment) 42 positioned at the second receiving space 353. The first handle body 41 is pivotably secured to the outer frame 311 via the hinge shaft 43. The second handle body 42 may extend from a free end of the first handle body 41 in a bent manner toward the partitioning wall 35.

The second handle body 42 includes a first input (or first movement surface) 45 and a second input 46 (or second movement surface, see FIG. 6) that actuate a first actuator 61 and 63 and a second actuator 67 and 68 as described below according to a pivot angle of the first handle body 41. The first actuator 61 and 63 and second actuator 67 and 68 may be disposed in the door body 31 to allow the user to actuator the pivoting axis (X, Y) for the door. A detailed description thereof will be described later.

In the laundry-treating apparatus having the above-described structure, when the user inserts a finger into the first receiving space 351 and pivots the first handle body 41 toward the outer frame 311 (when an external force is input to the first handle body), the second handle body 42 will move toward the outer frame 311. Then, the first input 45 fixed to the second handle body 42 inputs an external force to the first actuator 61 and 63 to actuate the first actuator 61 and 63, while the second input 46 inputs the external force to the second actuator 67 and 68 so that the second actuator 67 and 68 is actuated. A specific structure of each of the switches 61 and 63, 67, and 68 and the actuation process thereof will be described later.

Figure 3:
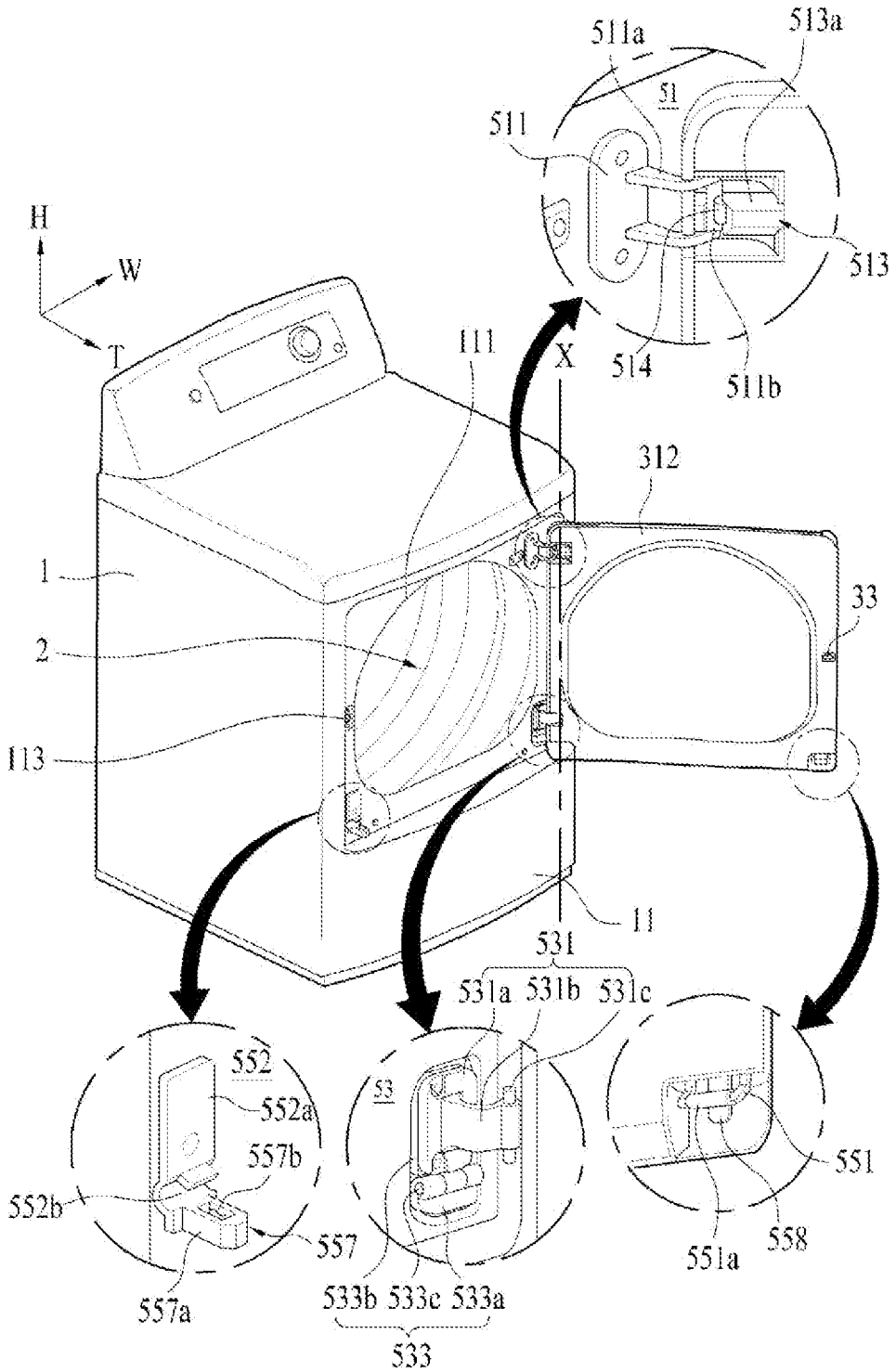
FIG. 3 shows a case when the door pivots about a first pivoting axis to open the laundry inlet.

As shown in FIG. 3, the hinges 51, 53 and 55 for coupling the door body 31 to the front panel 11 include a first hinge 51 having a first shaft 511*b*, a third hinge 551 and 552 having a fourth shaft 551*a*, and a second hinge 53 having a second shaft 531*c* defining a first pivoting axis X together with the first shaft 511*b*, and a third shaft 533*c* defining a second pivoting axis Y (see FIG. 1) together with the fourth shaft 551*a*.

The first hinge 51 may include a first hinge body 511 disposed on one of the front panel 11 and the door body 31. The first shaft 511*b* is fixed to the first hinge body 511. The first hinge 51 may further include a first shaft receiving structure 513 which is disposed on the other of the front panel 11 and the door body 3. The first shaft 511 is detachably received in first shaft receiving structure 513.

FIG. 3 shows one example in which the first hinge body 511 is fixed to the front panel 11, and the first shaft receiving structure 513 is disposed on the door body 31. In this case, the first hinge body 511 includes a shaft support 511*a* supporting the first shaft 511*b*. The shaft support 511*a* may protrude from the front panel 11 and be bent in a direction parallel to the front panel and away from the laundry inlet 111.

Figure 4:
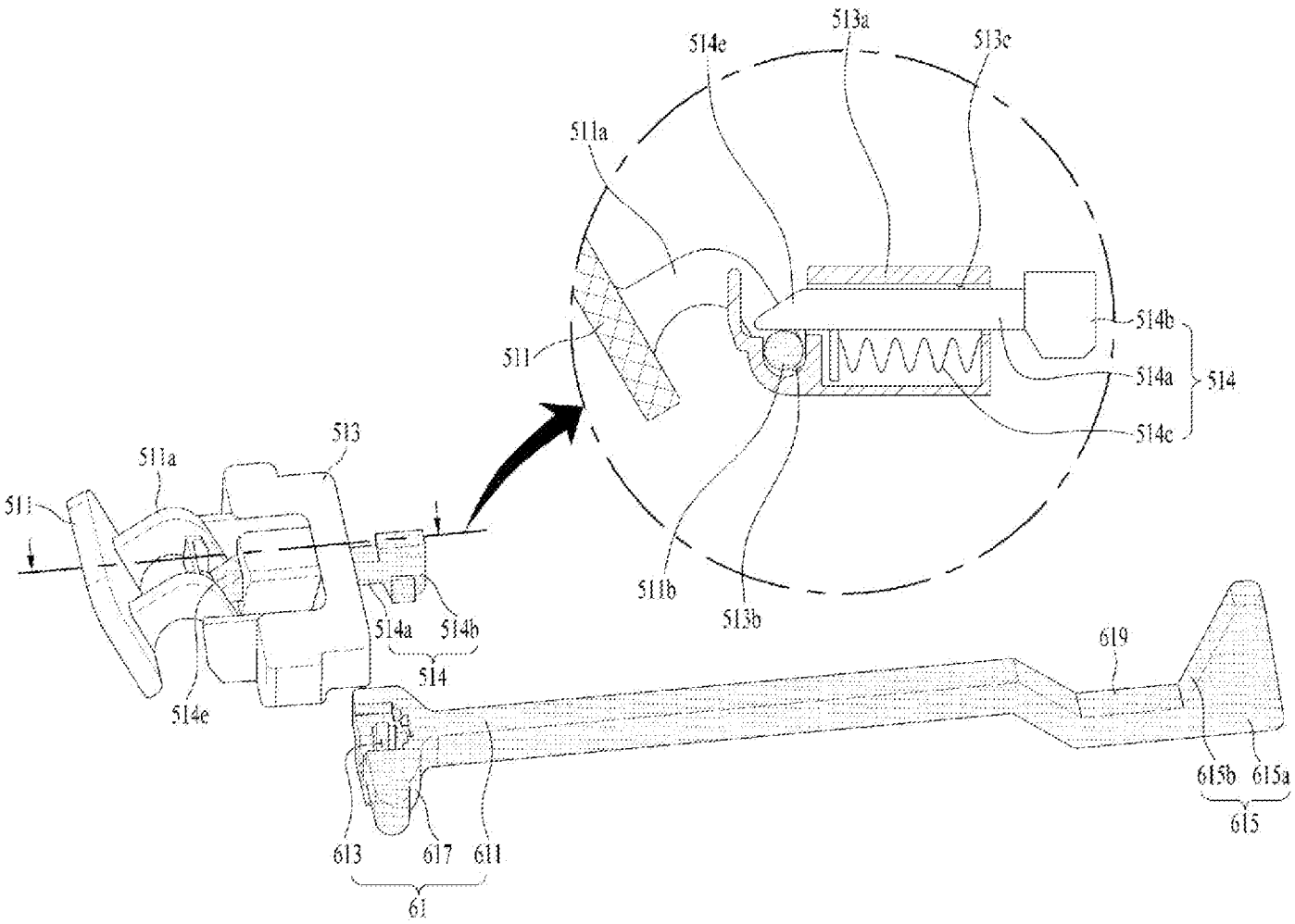
FIG. 4 and FIG. 5 show an example of a first shaft controller and a fourth shaft controller according to the present disclosure.

As shown in FIG. 4, the first shaft receiving structure 513 includes a housing 513*a* fixed to the door body 31, and a first shaft receiving space 513*b* defined in the housing 513*a* to provide a space for accommodating the first shaft 511*b*. In this case, the first shaft receiving space 513*b* should be disposed on the inner frame 312 so as to be exposed to the outside.

In one example, the first shaft receiving structure 513 may include a first shaft controller (or first latch) 514 that opens and closes the first shaft receiving space 513*b*. The first shaft controller 514 may include a first bar 514*a* (first shaft controlling body) inserted into a controller guide 513*c* passing through the housing 513*a*. The controller guide 513*c* acts for providing a path along which the first shaft controller 514 moves.

One end of the first bar 514*a* includes a head 514*b* that is detachably secured to a first driving portion or body 61 or a second driving portion or body 63 to be described later. Thus, the free end 514*e* of the first bar 514*a* may open or close the first shaft receiving space 513*b* depending on whether the head 514*b* moves.

When the free end 514*e* of the first bar 514*a* closes the first shaft receiving space 513*b*, the first shaft 511*b* is prevented from being drawn out of the first shaft receiving space 513*b*. However, when the free end 514*e* opens the first shaft receiving space 513*b*, the first shaft 511*b* may be withdrawn from the first shaft receiving space 513*b* or be insertable into the first shaft receiving space 513*b*.

In one example, the first bar 514*a* may be configured to receive a restoring force from an elastic member 514*c*, thereby allowing the bar 514*a* to return to an initial position. The elastic member 514*c* may include a spring. One end of the spring is fixed to the housing 513*a* and the other end thereof is fixed to the first bar 514*a*. In this case, the elastic member 514*c* is preferably configured to supply an elastic force to the first bar 514*a* so that the free end 514*e* of the first bar keeps closing the first shaft receiving space 513*b*.

Figure 6:
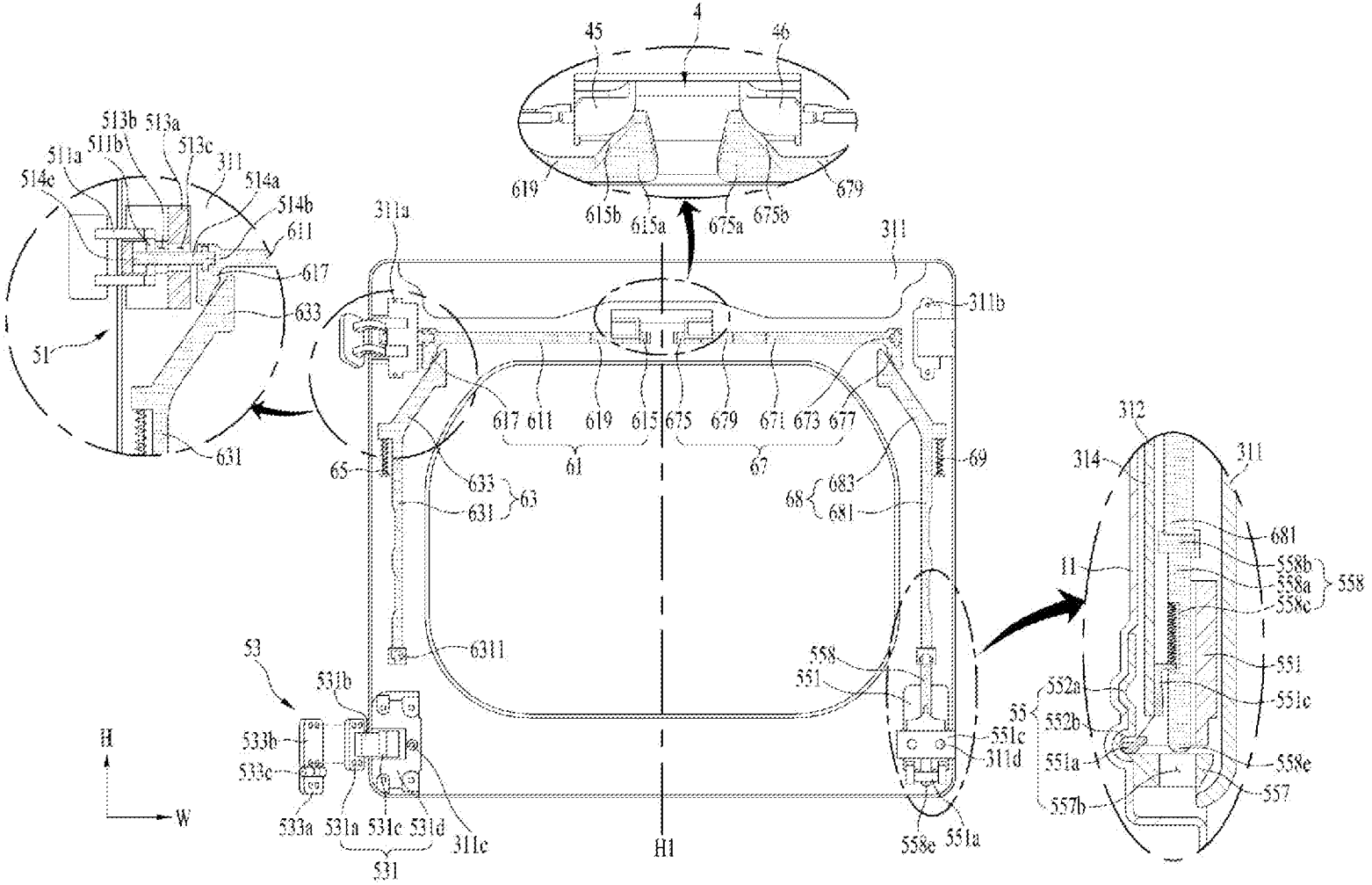
FIG. 6 and FIG. 7 show an actuation process of a first actuator and a second actuator.

As described in FIG. 6, the first hinge 51 may be fixed to either a left side of the door or a right side of the door via a first fastener 311*a* or a second fastener 311*b* disposed on the outer frame 311 respectively. The first fastener 311*a* and the second fastener 311*b* may be arranged to have an axial symmetry to each other around a vertical line H1 passing through a center of the door.

As shown in FIG. 3, the second hinge 53 may include a door support 531 having a second shaft 531*c*, and a cabinet hinge portion 533 for pivotably fixing the door support 531 to the front panel 11 via a third shaft 533*c*.

The cabinet hinge portion 533 may include a hinge body 533*a* secured to the front panel 11 and a pivotable plate 533*b* pivotably coupled to the hinge body 533*a* via the third shaft 533*c*.

In this case, the door support 531 may include a support body 531*a* fixed to the pivotable plate 533*b*, and a second shaft support 531*b* protruding from the support body 531*a* to support the second shaft 531*c*.

The second shaft 531*c* is pivotably coupled to the door body 31 via a second shaft cover 531*d* (see FIG. 6). The second shaft 531*c* is aligned with the first shaft 511*b* of the first hinge 51 in a linear manner. Thus, the first pivoting axis X is defined by the first shaft 511*b* and second shaft 531*c*.

The third hinge may include a fourth shaft 551*a* disposed on one of the door body 31 and the front panel 11, a fourth shaft receiving structure 552 disposed on the other of the door body 31 and the front panel 11. The fourth shaft 551*a* is detachably received in the fourth shaft receiving structure 552. FIG. 3 shows an example in which the fourth shaft 551*a* is disposed on the door body 31 and the fourth shaft receiving structure 552 is disposed on the front panel 11.

The fourth shaft receiving structure 552 may include a body 552*a* secured to the front panel 11, a fourth shaft receiving space 552*b* defined in the body 552*a* and providing a space for receiving the fourth shaft 551*a*, and a controller receiving portion 557 extending from the body 552*a*. and a controlling-body receiving portion 557 extending from the body 552*a*. A fourth shaft controller (or fourth shaft latch) 558 as described later is inserted into the controller receiving portion 557.

The fourth shaft receiving space 552*b* may be embodied as a groove formed by concavely bending the body 552*a*. The fourth shaft receiving space 552*b* is aligned in parallel with (in the same straight line) the third shaft 533*c* of the second hinge 53. The fourth shaft 551*a* inserted in the fourth shaft receiving space 552*b* defines the second pivoting axis Y (see FIG. 1) together with the third shaft 533*c*.

The controller receiving portion 557 may include a receiving body 557*a* protruding from the body 552*a* and located below the fourth shaft receiving space 552*b*, and a through-hole 557*b* penetrating the receiving body 557*a*.

Figure 5:
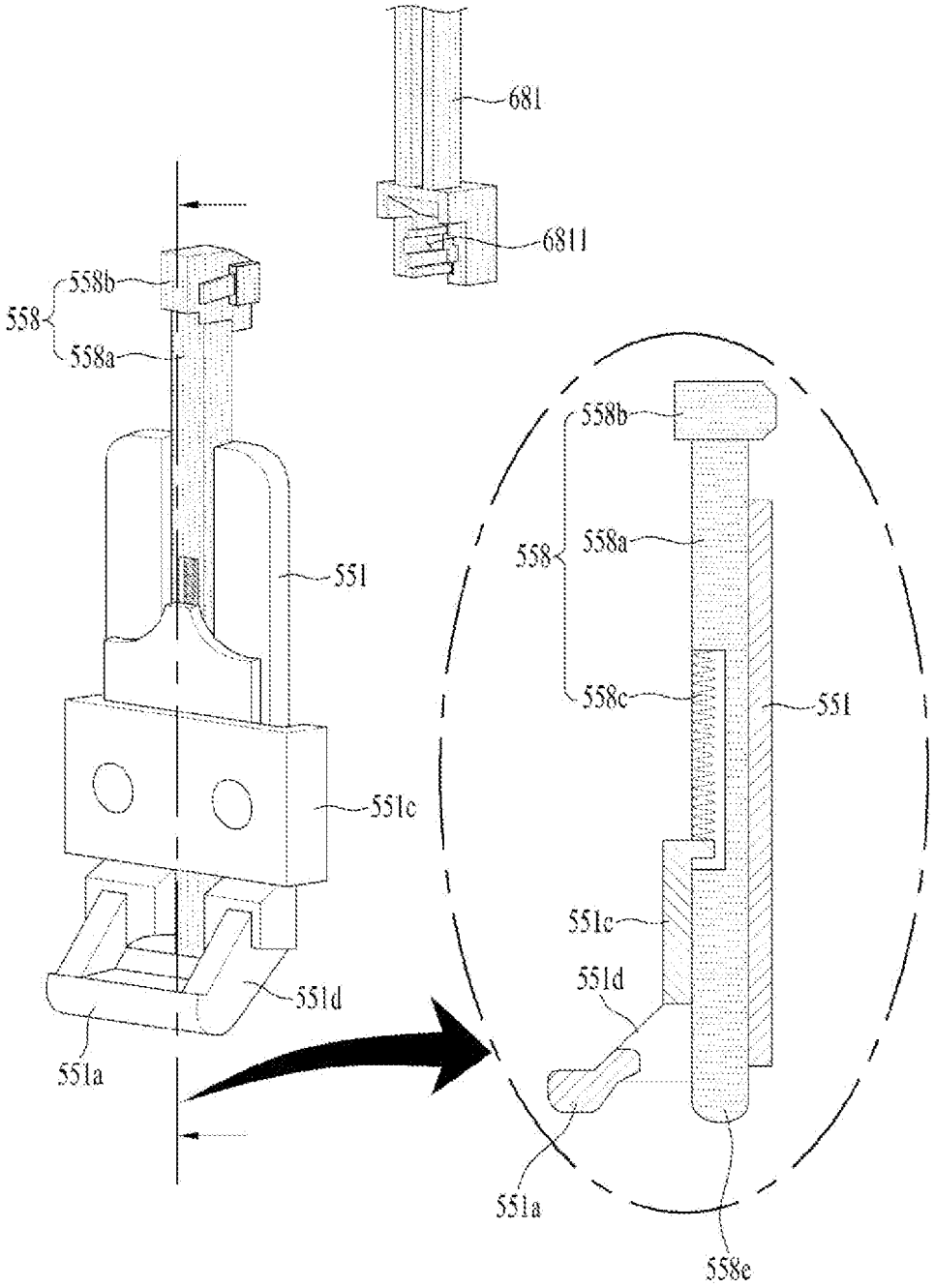

In one example, as shown in FIG. 5, the fourth shaft 551*a* may be disposed on a third hinge body 551 fixed to the door body 31. The third hinge body 551 includes a fourth shaft support 551*d* that spaces the fourth shaft 551*a* from the third hinge body 551 by a predetermined distance. The fourth shaft 551*a* fixed to the fourth shaft support 551*d* is exposed to the outside of the inner frame 312.

The third hinge body 551 includes a fourth shaft controller 558 that opens and closes the fourth shaft receiving space 552*b*. The fourth shaft controller 558 may include a second bar 558*b* (a fourth shaft controlling body) that are reciprocally movable along the vertical direction of the third hinge body 551.

In this case, the third hinge body 551 may further include a guide 513*c* for providing a travel path of the second bar 558*b*. The guide 513*c* may include at least one of a groove extending in a vertical direction of the third hinge body 551 and receiving the second bar 558, and a cover (not shown) that prevents the second bar 558 inserted in the groove from being pulled out of the groove.

One end of the second bar 558 includes a head 558*b* detachably coupled to a first driven portion 63 or a second driven portion 68. A free end 558*e* of the second bar 558 is inserted in a space defined within the fourth shaft support 551*d* and defined between the fourth shaft 551*a* and the third hinge body 551.

Thus, the free end 558*e* of the second bar may open or close the fourth shaft receiving space 552*b* depending on whether the driven portion 63 or 68 has moved the head 558*b*. When the free end 558*e* of the second bar is inserted into the through-hole 557*b* to close the fourth shaft receiving space 552*b*, the fourth shaft 551*a* is prevented from being drawn out from the fourth shaft receiving space 552*b*. In this case, the free end 558*e* of the second bar will be inserted into the through-hole 557*b*. To the contrary, when the second body free end 558*e* is drawn from the through-hole 557*b* and opens the fourth shaft receiving space 552*b*, the fourth shaft 551*a* may be withdrawn from the fourth shaft receiving space 552*b* or be insertable into the fourth shaft receiving space 552*b*.

The second bar 558*a* may be configured to be receive a restoring force from a second elastic member 558*c* such that the bar 558*a* returns to its initial position. The second elastic member 558*c* may be embodied as a spring having one end fixed to the third hinge body 551, and the other end fixed to the second bar 558*a*. FIG. 5 shows an example in which the second elastic member 558*c* is fixed to the third hinge body 551 through the guide 551*c*.

The second elastic member 558*c* is preferably configured to provide an elastic force to the second bar 558*a* so that the free end 558*e* of the second bar keeps opening the fourth shaft receiving space 552*b*.

As shown in FIG. 6, the second hinge 53 may be fixed to the door 3 via a shaft cover fastener 311*c* disposed on the outer frame 311. The third hinge 55 may be fixed to the door 3 via a body fastener 311*d* disposed on the outer frame 311.

In this case, the second hinge 53 may be fixed to the door via the cover fastener 311*c* (for example, bolt) passing through the second shaft cover 531*d*. The third hinge 55 will be secured to the door via the body fastener 311*d* (for example, bolt) passing through the third hinge body 551 or guide 551*c*.

In order that a position of the second hinge 53 and a position of the third hinge 55 may be exchanged with each other, the shaft cover fastener 311*c* and the body fastener 311*d* may be disposed axially symmetrically with each other around the vertical line H1 passing through the center of the door.

As shown in FIG. 6, the door 3 contains the first pivoting-axis switch 61 and 63 and the second pivoting-axis switch 67 and 68 which control the position of the first shaft controller 514 and the fourth shaft controller 558 based on whether an external force is input to the handle 4.

The first actuator includes a first driving portion 61 reciprocally movable along a width direction W of the door and a first driven portion 63 reciprocally movable along a vertical direction H of the door.

The first driving portion 61 may be configured to move toward the handle 4 when an external force is applied to the handle 4. The first driven portion 63 may be configured to move toward the second hinge 53 as the first driving portion 61 moves toward the handle 4.

The first driving portion 61 may include a bar-shaped first driving body (or first driving linkage or arm or extension) 611 positioned between the handle 4 and the first shaft controller 514. One end of the first driving body 611 includes a first movable portion 617 and a first attached and detached portion (or first accommodation groove) 613 (see FIG. 4) into which the first shaft controller 514 is detachably fixed. The other end of the first driving body 611 includes a first contact 615 which is pressurized by the first input 45 disposed on the handle.

The first attached and detached portion 613 may be embodied in any shape as long as the attached and detached portion 613 can detachably or fixedly receive the head 514*b* of the first shaft controller.

The first movable portion 617 protrudes from the first driving body 611 toward the first driven portion 63, toward the second hinge 53.

The first contact 615 may act for transferring an external force input to the handle to the first driving body 611 when the contact 615 contacts the first input 45 when an external force is input to the handle 4. To this end, the first contact 615 includes a contact body 615*a* projecting from the first driving body 611 toward the first input 45, and an inclined face 615*b* formed on the contact body and contacting the first input 45. The inclined face 615*b* may incline upwards as it goes away from the first attached and detached portion 613.

Since the first contact 615 must be disposed inside the door body 31 with a limited thickness, the first driving body 611 may further includes a first bent portion 619 bent toward the outer frame 311, and the first contact 615 may be coupled to the first bent portion 619.

The first elongated driven structure 63 includes a first driven body (or first driven linkage or arm or extension) 631 located between the first hinge 51 and the second hinge 53, and a first contact portion 633 extending from the first driven body 631 toward the first driving body 611.

The first driven body 631 may include a bar configured to reciprocate between the first hinge 51 and the second hinge 53. One end of the first driven body 631 includes a first attached and detached portion 6311 into which the fourth shaft controller 558 is detachably secured.

The first contact portion 633 may refer to means for delivering, to the first driven body 631, an external force transmitted to the first driving body 611 via the first input 45 disposed in the handle. The first contact portion 633 may be inclined to contact the first movable portion 617.

In the laundry-treating apparatus according to the present disclosure, the first shaft 511*b* disposed in the first hinge and the second shaft 531*c* disposed in the second hinge together define the first pivoting axis X. The first driven body 631 is configured to reciprocate between the first shaft and the second shaft along the first pivoting axis X. Thus, the first contact portion 633 may include an inclined face inclined towards the handle 4 as the first contact portion 633 extends away from the first attached and detached portion 6311.

In one example, the first contact portion 633 may be configured to be kept in contact with the first movable portion 617 via the first restoring means 65. The first restoring means or elastic member 65 may include a spring that urges the first driven body 631 toward the first driving body 611.

The second actuator 67 and 68 may have the same structure as the first actuator 61 and 63. That is, as shown in FIG. 6, the second actuator includes a second driving portion 67 reciprocating along the width direction W of the door, and a second driven portion 68 reciprocating along the height direction H of the door.

When an external force is input to the handle 4, the second driving portion 67 is configured to move toward the handle 4. When the second driving portion 67 moves towards the handle 4, the second driven portion 68 may be configured to move toward the fourth hinge 55.

The second driving portion 67 may include a second driving body (or second driving linkage or arm or extension) 671 having a bar shape. The second driving portion 67 may reciprocate in the same straight line as the first driving portion 61. The second driving body 67 may reciprocate between the handle 4 and the second fastener 311*b*.

One end of the second driving body 671 includes a second movable portion 677 and a second attached and detached portion 673 into which the first shaft controller 514 is detachably secured. The other end of the second driving body 671 includes a second contact 675 pressed by the second input 46 disposed on the handle.

The second driving body 671 includes the second attached and detached portion 673. Thus, the first shaft controller 514 may be fixed to the first driving portion 61 or to the second driving portion 67.

The second movable portion 677 is projected from the second driving body 671 towards the second elongated driven structure 68, that is, towards the fourth shaft 551*a*.

When an external force is applied to the handle 4. the second contact 675 contacts the second input 46 and delivers the external force from the second input of the handle to the second driving body 671.

To this end, the second contact 675 includes a contact body 675*a* protruding from the second driving body 671 toward the second input 46, and an inclined face 675*b* disposed on the contact body and contacting the second input 46. The inclined face 675*b* may be configured to be inclined upward as the face 675*b* extends away from the second attached and detached portion 673.

Since the second contact 675 should be disposed in the door body 31 with a limited thickness, the second driving body 671 has a second bent portion 679 bent toward the outer frame 311. The second contact 675 may be formed on the second bent portion 679.

The second driven portion 68 may include a second driven body (or second driven linkage or arm or extension) 681 shaped like a bar that reciprocates between the second fastener 311*b* and the fourth shaft 551*a*, and a second contact portion 683 extending from the second driven body 681 toward the second driving body 671.

One end of the second driven body 681 includes a second attached and detached portion 6811 into which the head 558*b* of the fourth shaft controller is removably secured. Thus, the fourth shaft controller 558 may be fixed to the first driven portion 63 or the second driven portion 68.

The second contact portion 683 may refer a means for delivering, to the second driven body 671, an external force transmitted to the second driving body 671 via the second input 46 disposed on the handle. The second body contact 683 may be inclined to contact the second movable portion 677. The second contact portion 683 may be configured to include an inclined face that faces the handle 4 as the portion 683 extends away from the second attached and detached portion 6811.

In one example, the second contact portion 683 may be configured to be kept in contact with the second movable portion 677 via a second elastic member 69. The second elastic member 69 may include a spring that urges the second driven body 681 toward the second driving body 671.

Figure 7:
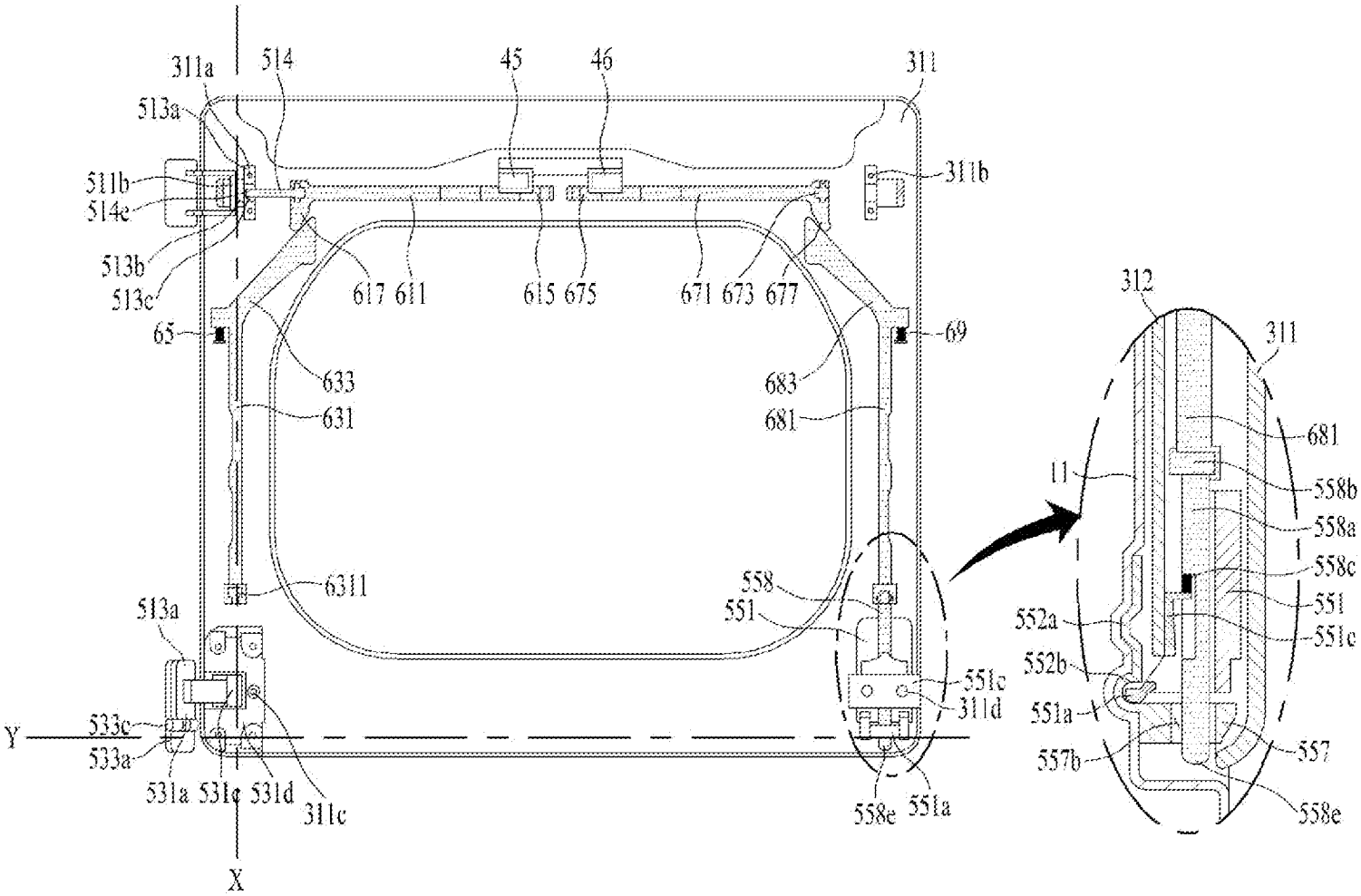

The actuation process of the first actuator 61 and 63 and the second actuator 67 and 68 having the above structure is as shown in FIG. 7.

When an external force is input to the handle 4, the first input 45 presses the inclined face 615*b* of the first contact 615, while the second input 46 presses the inclined face 675*b* of the second contact 675.

When the inclined face 615*b* of the first contact and the inclined face 675*b* of the second contact are pressed in the above manner, the first driving body 611 and the second driving body 671 move towards the handle 4. That is, the first driving body 611 moves in a direction away from the first hinge 51, while the second driving body 671 moves away from the second fastener 311*b*.

When the first driving body 611 moves toward the handle 4, the first bar 514*a* of the first shaft controller will move toward handle 4. When the first bar 514*a* moves toward the handle 4, the free end 514*e* of the first bar will open the first shaft receiving space 513*b*.

Further, when the first driving body 611 moves toward the handle, the first movable portion 617 moves toward the handle 4. Then, the first contact portion 633 allows the first driven body 631 to move toward the second hinge 53.

Meanwhile, when the second driving body 671 moves toward the handle 4, the second movable portion 677 moves toward the handle 4. Thus, the second driven body 681 contacting the second movable portion 677 via the second contact portion 683 will move toward the fourth shaft 551*a*.

When the second driven body 681 moves toward the fourth shaft 551*a*, the second bar 558*a* of the fourth shaft controller fixed to the second driven body 681 will move toward the through hole 557*b* defined in the controller receiving portion 557.

When the free end 558*e* of the second bar is inserted into the through-hole 557*b*, the fourth shaft receiving space 552*b* is closed by the second bar 558*a*. Thus, the fourth shaft 551*a* will not be drawn out of the fourth shaft receiving space 552*b*. Therefore, the door 3 will be pivotable around the second pivoting axis Y.

In one example, when the external force input via the handle 4 disappears, the first actuator 61 and 63 and the second actuator 67 and 68 will be brought into a state of FIG. 6.

That is, when the external force input to the handle 4 disappears while the door 3 closes the laundry inlet 111, the first bar 514*a* of the first shaft controller and the first driving body 611 move in a direction away from the handle 4 via the first elastic member 514*c* disposed on the first shaft controller. The first driven body 631 is moved toward the first hinge 51 via the first elastic member 65.

When the first bar 514*a* moves away from the handle 4, the first shaft receiving space 513*b* will be closed by the first bar free end 514*e*. Thus, the first shaft 511*b* inserted in the first shaft receiving space 513*b* is prevented from being drawn out from the first shaft receiving space 513*b*.

Further, when the external force input to the handle 4 disappears, the restoring force supplied by the second elastic member 69 may allow the second driven body 681 to move away from the fourth shaft 551*a*. The second contact portion 683 and the second movable portion 677 allow the second driving body 671 to move in a direction away from the handle 4.

When the second driven body 681 moves away from the fourth shaft 551*a*, the free end 558*e* of the second bar of the fourth shaft controller is withdrawn from the through-hole 557*b*. Thus, the door 3 may be secured to the first pivoting axis X.

When, in this state, the user pulls the door 3 without pressing the handle 4, the door 3 will pivot around the first pivoting axis X to open the laundry inlet 111.

The laundry-treating apparatus 100 having the above-described structure has the effect of facilitating the change of the position of the first pivoting axis X from one of the left side and the right side of the door to the other of the left side and right side of the door 3.

The users of the laundry-treating apparatus may be classified into a left-handed person and a right-handed person. Thus, the manufacturer of the laundry-treating apparatus or the installer of the laundry-treating apparatus need to change the position of the first pivoting axis X according to the user's preference. The laundry-treating apparatus 100 according to the present disclosure facilitates changing the position of the first hinge 51 from the left side of the door to the right or from the right side of the door to the left side, moving the second hinge 53 toward the third hinge 55, and moving the third hinge 55 toward the second hinge 53. Thus, this may simplify the process of changing the first pivoting axis X by the producer or installer.

As shown in FIG. 6, the first hinge 51 includes the first shaft controller 514. The first shaft controller 514 may be coupled to each of the first driving body 611 and the second driving body 671. The first fastener 311*a* and the second fastener 311*b* are axially symmetrical with each other around the vertical line H1. Thus, when changing the position of the first hinge 51, the producer or the operator only needs to move the first hinge 511 from the first fastener 311*a* to the second fastener 311*b* while maintaining the first driving body 611 and the second driving body 671 as they are.

Further, the third hinge 55 includes the fourth shaft controller 558. The cover fastener 311*c* and the body fastener 311*d* are axial-symmetrical with respect to each other around the vertical line H1. Thus, when changing the position of the second hinge 53 and the third hinge 55, it may suffice that the operator secures the second hinge 53 to the body fastener 311*d*, and secures the third hinge 55 to the cover fastener 311*c* while maintaining the first driven body 631 and the second driven body 681 as they are.

In the above-described embodiment, each of the inclined face 615*b* disposed on the first driving body 611 and the inclined face 675*b* disposed on the second driving body 671 is configured to be inclined upwardly as each of the inclined face 615*b* and inclined face 675*b* extends away from each of the corresponding attached and detached portions 613 and 673. However, the present disclosure is not limited thereto. Each of the inclined face 615*b* disposed on the first driving body 611 and the inclined face 675*b* disposed on the second driving body 671 may be configured to be inclined downwardly as each of the inclined face 615*b* and inclined face 675*b* extends away from each of the corresponding attached and detached portions 613 and 673.

In the latter case, when an external force is input to the handle 4, the first driving body 611 will move toward the first hinge 51, and the second driving body 671 will move toward the second fastener 311*b*. Accordingly, a shape and position of each of the first movable portion 617 and the first contact portion 633 should be changed so that the first driven body 631 moves toward the second hinge 53 while the first driving body 611 moves toward the first hinge 51. For the same reason, the shape and position of each of the second movable portion 677 and the second contact portion 683 must be changed in the same manner.

Further, when each of the inclined face 615*b* disposed on the first driving body 611 and the inclined face 675*b* disposed on the second driving body 671 is configured to be inclined downwardly as each of the inclined face 615*b* and inclined face 675*b* extends away from each of the corresponding attached and detached portions 613 and 673, the first elastic member 514*c* disposed on the first shaft controller 514 is preferably configured to provide an elastic force to the first bar 514*a* so that the free end 514*e* of the first bar is kept to open the first shaft receiving space 513*b*.

As shown in FIG. 2, for the laundry-treating apparatus 100 having the above-described structure, during the actuation of the handle 4, the second handle body 42 may collide with the partitioning wall 35. This may deteriorate the durability of the partitioning wall and the second handle body or may generate noise.

In order to solve such a problem, the laundry-treating apparatus 100 according to the present disclosure may further include a damper 47. The damper 47 may be disposed on at least one of the second handle body 42 and the partitioning wall 35 to prevent collision between the partitioning wall 35 and the second handle body 42.

The damper 47 may include an elastic body 471, which may be embodied as an elastic member, such as rubber. In one example, the damper 47 may further include at least one a protrusion 475 extending from a face of the elastic body 471 to be in contact with the second handle body 42, and a groove 473 defined in a face of the elastic body 471 facing the partitioning wall 315.

The protrusion 475 or the groove 473 may easily absorb the kinetic energy of the second handle body 42 when the door closes the laundry inlet 111 and thus the second handle body 42 moves toward the partitioning wall 315. Thus, the protrusion 475 or the groove 473 may effectively prevent the collision between the second handle body 42 and the partitioning wall 315.

In one example, the laundry-treating apparatus 100 according to the present disclosure must actuate the first driving body 611 and the second driving body 671 separated from each other using a single handle 4. Thus, for the actuation of the handle 4, the user must input a large force into the first handle body 41.

In order to minimize a magnitude of the external force input to the handle 4 for the actuation of the first driving body 611 and the second driving body 671, the laundry-treating apparatus 100 according to the present disclosure may further include a power transmission mechanism 62.

Figure 8:
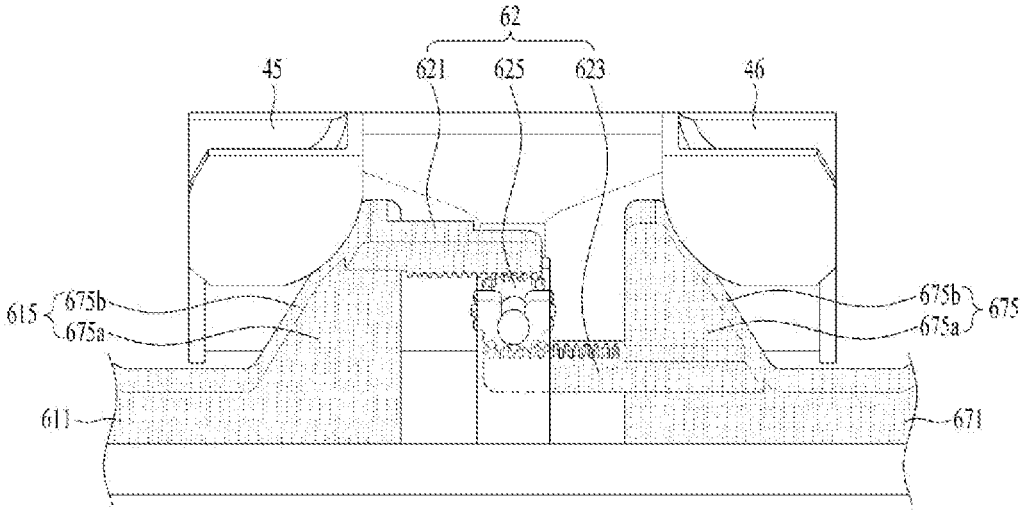
FIG. 8 shows an example of a power transmission mechanism according to the present disclosure.

As shown in FIG. 8, the power transmission mechanism 62 may include a first rack 621 fixed to the first contact 615 and projecting toward the second contact 675, a second rack 623 fixed to the second contact 635 and projecting toward the first contact 615, and a connection gear 625 which connects the first rack 621 to the second rack 623.

The connection gear 625 is rotatably secured to the door 3 via a shaft to connect the first rack 621 and the second rack 623 to each other. Therefore, this configuration may allow transmitting the external force inputted to one of the first rack 621 and the second rack 623 to the other rack.

The present disclosure may be embodied in various forms without departing from the scope of the invention. Therefore, when modified embodiments include elements recited claims according to the present disclosure, the modified embodiments should be regarded as belonging to the scope of the present disclosure.

What is claimed is:

1. A laundry-treating apparatus comprising:

a cabinet having an inlet defined therein;

a door provided to open and close the inlet;

a first hinge including:

a first shaft provided at one of the cabinet or the door; and a first shaft receiving space provided at the other of the cabinet and the door, wherein the first shaft receiving space is configured to receive the first shaft therein; and a first shaft latch configured to selectively release the first shaft from the first shaft receiving space;

a second hinge including:

a second shaft that is coaxial with the first shaft and coupled to the door, wherein the first and second shafts collectively define a first pivoting axis about which the door pivots in a first direction; and a third shaft arranged perpendicular to the second shaft, wherein the third shaft defines a second pivoting axis about which the door pivots in a second direction different from the first direction;

a third hinge including:

a fourth shaft provided at one of the cabinet or the door, wherein the third and fourth shafts are coaxial and collectively define the second pivoting axis;

a fourth shaft receiving space provided at the other of the cabinet and the door, wherein the fourth shaft receiving space is configured to receive the fourth shaft therein; and a fourth shaft latch configured to selectively release the fourth shaft from the fourth shaft receiving space;

a handle provided in the door;

first and second driving linkages respectively provided on either side of the handle and each having a first end in contact with the handle, wherein when an external force is applied to the handle, each of the first and second driving linkages is configured to move toward or away from a vertical centerline of the door;

a first driven linkage having a first end in contact with the first driving linkage, and a second end as a free end that extends towards the second hinge, wherein the first driven linkage is configured to move toward the second hinge when the first driving linkage actuates the first shaft latch to release the first shaft from the first shaft receiving portion; and a second driven linkage having a first end in contact with the second driving linkage, and a second end as a free end that extends towards the third hinge, wherein the second driven linkage is configured to move toward the third hinge when the second driving linkage actuates the first shaft latch to release the first shaft from the first shaft receiving portion;

wherein the first shaft latch is detachably secured to one of a second end of the first driving linkage and a second end of the second driving linkage, and wherein the fourth shaft latch is detachably secured to one of the second end of the first driven linkage and the second end of the second driven linkage.

2. The laundry-treating apparatus of claim 1, wherein each of the first and second driving linkages further includes an accommodation groove into which a first end of the first shaft latch is configured to be received.

3. The laundry-treating apparatus of claim 1, wherein each of the first and second driven linkages further includes an accommodation groove into which a first end of the fourth shaft latch is configured to be received.

4. The laundry-treating apparatus of claim 1, wherein the first hinge further includes:

a housing secured to the door, the housing defining the first shaft receiving space;

a guide provided at the housing to guide a movement of the first shaft latch; and a first spring having a first end fixed to the housing and the other a second end fixed to the first shaft latch, wherein the first spring presses the first shaft latch to close the first shaft receiving space.

5. The laundry-treating apparatus of claim 4, further comprising:

a first fastener attached at a first lateral side of the door and configured to fix the housing to face the second end of the first driving linkage; and a second fastener attached at a second lateral side of the door and configured to fix the housing to face the second end of the second driving linkage, wherein the first fastener and the second fastener are arranged to be axially symmetrical with each other about the vertical centerline of the door.

6. The laundry-treating apparatus of claim 1, wherein the third hinge further includes:

a third hinge body fixed to the door;

a fourth shaft support configured to secure the fourth shaft to the third hinge body and to provide a space between the fourth shaft and the third hinge body;

a fourth shaft receiving space fixed on the cabinet, wherein the fourth shaft receiving space is configured to receive the fourth shaft; and a second spring having a first end fixed to the third hinge body and a second end fixed to the fourth shaft latch, wherein the second spring is configured to press the fourth shaft latch to open the fourth shaft receiving space.

7. The laundry-treating apparatus of claim 6, wherein the third hinge further includes a guide provided at the third hinge body, wherein the guide is configured to guide the fourth shaft latch to open and close the fourth shaft receiving space when the door is in a closed position.

8. The laundry-treating apparatus of claim 6, wherein the third hinge further includes a latch receiving body provided below the fourth shaft receiving space, wherein the latch receiving body includes a through hole, and wherein a second end of the fourth shaft latch is configured to be received into the through hole.

9. The laundry-treating apparatus of claim 6, further comprising:

a cover configured to cover the second shaft within the door;

a cover fastener configured to secure the cover to the door; and a body fastener configured to secure the third hinge body to the door, wherein the cover fastener and body fastener are positioned axially symmetrical to each other about the vertical centerline of the door.

10. The laundry-treating apparatus of claim 1, wherein the handle includes:

a handle body pivotally secured to the door; and first and second inputs provided on the handle body and spaced apart from each other about the vertical centerline of the door, wherein the first driving linkage includes a first contact point, wherein when the handle body pivots, the first input presses the first contact point to move the first driving linkage toward the handle body, wherein the second driving linkage includes a second contact point, wherein when the handle body pivots, the second input presses the second contact point to move the second driving linkage toward the handle body.

11. The laundry-treating apparatus of claim 10, further comprising:

a first rack that extends from the first driving linkage toward the second driving linkage;

a second rack that extends from the second driving linkage toward the first driving linkage; and a connection gear configured to be engaged with the first rack and the second rack, wherein the connection gear is configured to allow the first rack and the second rack to move relative to each other.

12. The laundry-treating apparatus of claim 10, wherein the door has a first receiving space exposed to an outside and a second receiving space separated from the first receiving space via a partition wall, wherein the handle body includes:

a first handle body segment having a first end provided in the first receiving space and pivotably secured to the door, and a second end provided in the second receiving space, wherein the first handle body segment passes through the partition wall; and a second handle body segment coupled to the first handle body segment and provided in the second receiving space, wherein the second handle body segment includes the first input and the second input, wherein when the first driving linkage and the second driving linkage move away from the handle body, the second handle body segment moves toward the partition wall.

13. The laundry-treating apparatus of claim 12, further comprising a damper to prevent the second handle body segment from colliding with the partition wall.

14. The laundry-treating apparatus of claim 13, wherein the damper includes an elastic body secured to one of the partition wall and the second handle body segment and positioned to prevent the second handle body segment from colliding with the partition wall.

15. A home appliance comprising:

a cabinet having an inlet defined therein;

a door provided to open and close the inlet;

a first hinge including:

a first shaft provided at the cabinet; and a first shaft receiving space provided at the door and configured to receive the first shaft;

a second hinge including:

a second shaft that is coaxial with the first shaft and coupled to the door, wherein the first and second shafts collectively define a first pivoting axis about which the door pivots in a first direction; and a third shaft arranged perpendicular to the second shaft, wherein the third shaft defines a second pivoting axis about which the door pivots in a second direction different from the first direction;

a third hinge including:

a fourth shaft provided at the door, wherein the third and fourth shafts are coaxial and collectively define the second pivoting axis;

a fourth shaft receiving space provided at the cabinet and configured to receive the fourth shaft therein;

first and second driving linkages respectively provided on either side of the handle and each having a first end in contact with the handle, wherein when an external force is applied to the handle, each of the first and second driving linkages is configured to move toward or away from a vertical centerline of the door;

a first linkage body having a first end in contact with the first driving linkage, and a second end as a free end that extends towards the second hinge, wherein the first driven linkage is configured to move toward the second hinge when the first driving linkage actuates a first shaft latch to release the first shaft from the first shaft receiving portion; and a second driven linkage having a first end in contact with the second driving linkage, and a second end as a free end that extends towards the third hinge, wherein the second driven linkage is configured to move toward the third hinge when the second driving linkage actuates the first shaft latch to release the first shaft from the first shaft receiving portion.

16. The home appliance of claim 15, wherein the first shaft latch is attached to a second end of the first driving linkage or the second driving linkage.

17. The home appliance of claim 16, further comprising a first spring having a first end connected to the first shaft latch and a second end connected to the door, wherein the spring is configured to press the first shaft latch toward the first shaft receiving space.

18. The home appliance of claim 17, further comprising a handle, wherein the handle includes:

a handle body pivotally secured to the door; and first and second inputs provided on the handle body and spaced apart from each other about the vertical centerline of the door, wherein the first driving linkage includes a first contact point, wherein when the handle body pivots, the first input presses the first contact point to move the first driving linkage toward the handle body, wherein the second driving linkage includes a second contact point, wherein when the handle body pivots, the second input presses the second contact point to move the second driving linkage toward the handle body.

19. The home appliance of claim 18, further comprising a fourth shaft latch connected to the first driven linkage or the second driven linkage, wherein the fourth shaft latch is configured to release the fourth shaft from the fourth shaft receiving space.

20. The home appliance of claim 19, further comprising:

a first rack that extends from the first driving linkage toward the second driving linkage;

a second rack that extends from the second driving linkage toward the first driving linkage; and a connection gear configured to be engaged with the first rack and the second rack, wherein the connection gear is configured to allow the first rack and the second rack to move relative to each other.

* * * * *